US009777521B2

(12) United States Patent
Edavana et al.

(10) Patent No.: US 9,777,521 B2
(45) Date of Patent: Oct. 3, 2017

(54) ENHANCED HINGE AND METHOD FOR PIVOTALLY AND REMOVABLY CONNECTING A MEMBER WITH A STRUCTURE

(71) Applicant: KONINKLIJKE PHILIPS N.V., Eindhoven (NL)

(72) Inventors: Roopesh Edavana, Bangalore (IN); Pavanlal Thampy, Kollam (NL)

(73) Assignee: Koninklijke Philips N.V., Eindhoven (NL)

( * ) Notice: Subject to any disclaimer, the term of this patent is extended or adjusted under 35 U.S.C. 154(b) by 71 days.

(21) Appl. No.: 14/442,738

(22) PCT Filed: Dec. 5, 2013

(86) PCT No.: PCT/IB2013/060670

§ 371 (c)(1),
(2) Date: May 14, 2015

(87) PCT Pub. No.: WO2014/091371

PCT Pub. Date: Jun. 19, 2014

(65) Prior Publication Data

US 2015/0300064 A1 Oct. 22, 2015

Related U.S. Application Data

(60) Provisional application No. 61/735,603, filed on Dec. 11, 2012.

(51) Int. Cl.
*E05D 7/10* (2006.01)
*E05D 3/02* (2006.01)
(Continued)

(52) U.S. Cl.
CPC ..... *E05D 7/1061* (2013.01); *A61G 11/006* (2013.01); *E05D 3/022* (2013.01);
(Continued)

(58) Field of Classification Search
CPC ..... E05D 1/06; E05D 7/10; E05D 7/1016; E05D 7/105; E05D 7/1061; E05D 7/1066;
(Continued)

(56) References Cited

U.S. PATENT DOCUMENTS 126,571 A * 5/1872 Otis ..... E05D 3/022 16/364
130,472 A * 8/1872 Brinser ..... E05D 3/022 16/361
(Continued)

FOREIGN PATENT DOCUMENTS

DE 3110114 A1 10/1982
IT 219405 Z2 2/1993
(Continued)

*Primary Examiner* — Jeffrey O Brien

(57) ABSTRACT

An enhanced hinge and method pivotally and removably connects a member from a structure. In one example, the hinge and method retains the member using a first hinge piece coupled to the structure and a second hinge piece coupled to the member. The first and second hinge pieces may be configured such that the second hinge piece is retained inside the first hinge piece in a closed position and is not free to be decoupled from the first hinge piece but is free to pivot to an open position at the closed position. At the open position the second hinge piece is inverted as compared to its position in the closed position, is free to pass through the first hinge piece and is free to be decoupled from the first hinge piece.

12 Claims, 8 Drawing Sheets

(51) Int. Cl.
*E05D 11/10* (2006.01)
*A61G 11/00* (2006.01)
*A61G 7/05* (2006.01)

(52) U.S. Cl.
CPC ..... *E05D 7/1066* (2013.01); *E05D 11/1007* (2013.01); *A61G 7/051* (2016.11); *A61G 7/0515* (2016.11); *A61G 7/0518* (2016.11); *E05D 2007/1094* (2013.01); *E05Y 2800/296* (2013.01); *E05Y 2800/33* (2013.01)

(58) Field of Classification Search
CPC ..... E05D 7/1083; E05D 7/12; E05D 7/121; E05D 7/123; E05D 2007/128; E05D 3/022; E05D 11/1007; E05D 2007/1094; A61G 7/0515; A61G 7/051; A61G 7/5018; A61G 11/005; A61G 11/006; A61G 11/007
USPC ..... 16/267, 231
See application file for complete search history.

(56) References Cited

U.S. PATENT DOCUMENTS 850,369 A * 4/1907 Higgins ..... E05D 7/1066 16/267
891,235 A * 6/1908 Diehl ..... E05D 7/1066 16/267
922,720 A * 5/1909 Peters et al. ..... E05D 7/1066 16/267
971,313 A * 9/1910 Sarchett ..... E05D 7/1066 16/267
993,154 A * 5/1911 Dailey ..... E05D 11/1007 16/348
1,045,525 A * 11/1912 Courson ..... E05D 7/1066 16/267
1,059,713 A * 4/1913 Courson ..... E05D 7/1066 16/267
1,633,916 A * 6/1927 Zoufal ..... E05D 7/12 16/384
2,765,949 A * 10/1956 Hillman ..... E05D 1/06 16/257
3,432,882 A * 3/1969 Farouche ..... E05D 1/06 16/257
5,017,039 A * 5/1991 Spiess ..... E02D 29/14 404/25
5,048,154 A * 9/1991 Swartzendruber .... E05D 7/1066 16/260
5,603,682 A * 2/1997 Grider ..... A47C 7/40 248/292.14
5,979,016 A * 11/1999 Fan ..... E05D 7/1077 16/266
5,980,449 A 11/1999 Benson et al.
6,123,401 A * 9/2000 Chiba ..... H04M 1/0216 16/332
6,163,927 A * 12/2000 Leu ..... E05D 7/1066 16/266
6,234,954 B1 5/2001 Mackin
6,352,295 B1 * 3/2002 Leitner ..... B60K 15/05 16/255
6,363,576 B1 * 4/2002 Hsu ..... E05D 1/06 16/239
6,457,196 B1 10/2002 Dykes et al.
6,491,621 B1 12/2002 Dykes
7,338,107 B1 * 3/2008 Wilcox ..... E05D 3/022 296/57.1
7,536,752 B2 * 5/2009 Laursen ..... H04Q 1/09 126/194
7,757,349 B2 * 7/2010 Laursen ..... H04Q 1/09 16/358
8,482,906 B2 * 7/2013 Farley, Jr. ..... E05D 3/022 16/103
8,562,510 B2 * 10/2013 Koch ..... A61G 11/00 600/22
8,997,402 B2 * 4/2015 Mao ..... E05F 1/10 49/158
9,376,845 B2 * 6/2016 Sawaguchi ..... E05D 3/022
9,394,735 B2 * 7/2016 Jones ..... E05D 11/1007
2002/0164197 A1 * 11/2002 Lee ..... E05D 3/022 403/65
2004/0216274 A1 * 11/2004 Morgan ..... E05D 3/12 16/267
2008/0235907 A1 * 10/2008 Wayman ..... E05D 7/105 16/361
2012/0269568 A1 * 10/2012 Matsubara ..... A61G 11/006 403/104
2015/0167367 A1 * 6/2015 Sawaguchi ..... E05D 3/022 49/398
2015/0197378 A1 * 7/2015 Miller ..... B65D 43/166 220/810
2016/0017649 A1 * 1/2016 Akahane ..... H04N 1/00554 358/474
2016/0076186 A1 * 3/2016 Lee ..... D06F 37/28 312/228
2016/0181048 A1 * 6/2016 Whitaker ..... E05D 3/022 200/573
2016/0201371 A1 * 7/2016 Harding ..... B64C 1/14 244/129.4

FOREIGN PATENT DOCUMENTS

JP 6450145 U 3/1989
WO 9912511 A1 3/1999
WO 2009073699 A1 6/2009

* cited by examiner

ENHANCED HINGE AND METHOD FOR PIVOTALLY AND REMOVABLY CONNECTING A MEMBER WITH A STRUCTURE

CROSS-REFERENCE TO PRIOR APPLICATIONS

This application is the U.S. National Phase application under 35 U.S.C. §371 of International Application No. PCT/IB2013/060670, filed on Dec. 5, 2013, which claims the benefit of U.S. Provisional Patent Application No. 61/735,603, filed on Dec. 11, 2012. These applications are hereby incorporated by reference herein.

The present disclosure pertains to a method and hinge for pivotally and removably connecting a member with a structure.

Systems that hold infants, for example in position with respect to a warmer, are known. Such systems may employ a member, such as a fence or other structure, to retain an infant on a mattress or other support surface. The member may be held in a manner that facilitates rotation and/or removal to facilitate accessing the infant. Some such systems use spring loaded mechanisms to couple and decouple the members to and from the structure. Such spring loaded mechanisms can be complex and may make unpleasant sounds as the removable members are coupled to or removed from the structure.

Accordingly, one or more aspects of the present disclosure relate to a spring-less hinge for pivotally and removably connecting a member with a structure that is movable from a closed position to an opened position relative to the member and being removable from the member. The spring-less hinge comprises a first hinge piece constructed and arranged to be coupled to the structure and a second hinge piece constructed and arranged to be coupled to the member. The second hinge piece is movable from a first position to a second position relative to the first hinge piece when the structure is moved from the closed position to the open position. The first and second hinge pieces are configured such that when the second hinge piece is in the first position, the second hinge piece cannot be decoupled from the first hinge piece but can be pivoted relative to the first hinge piece, and such that when the second hinge piece is in the second position, it can then be further manipulated relative to the first hinge piece to enable the second hinge piece to be decoupled from the first hinge piece.

Yet another aspect of the present disclosure relates to a method for pivotally removing a member with a structure using a spring-less hinge having a first hinge piece constructed and arranged to be coupled to the structure and a second hinge piece constructed and arranged to be coupled to the member. To achieve this, the method moving the structure from a closed position to an open position by moving the second hinge piece from a first position to a second position relative to the first hinge piece, and decoupling the second hinge piece from the first hinge piece when the second hinge piece is in the second position. The first and second hinge pieces are configured such that when the second hinge piece is in the first position, the second hinge piece cannot be decoupled from the first hinge piece but can be pivoted relative to the first hinge piece, and such that when the second hinge piece is in the second position, it can then be further manipulated relative to the first hinge piece to enable the second hinge piece to be decoupled from the first hinge piece Still another aspect of present disclosure relates to a spring-less hinge for pivotally and removably connecting a member with a structure that is movable from a closed position to an opened position relative to the member and being removable from the member. The spring-less hinge comprises first hinge piece means constructed and arranged to be coupled to the structure and a second hinge piece means constructed and arranged to be coupled to the member. The second hinge piece means is moved from a first position to a second position relative to the first hinge piece means when the structure is moved from the closed position to the open position. The first and second hinge piece means is configured such that when the second hinge piece means is in the first position, the second hinge piece means cannot be decoupled from the first hinge piece means but can be pivoted relative to the first hinge piece means, and such that when the second hinge piece means is in the second position, it can then be further manipulated relative to the first hinge piece means to enable the second hinge piece means to be decoupled from the first hinge piece means.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

The embodiments will be more readily understood in view of the following description when accompanied by the below figures and wherein like reference numerals represent like elements, wherein.

Figure 1:
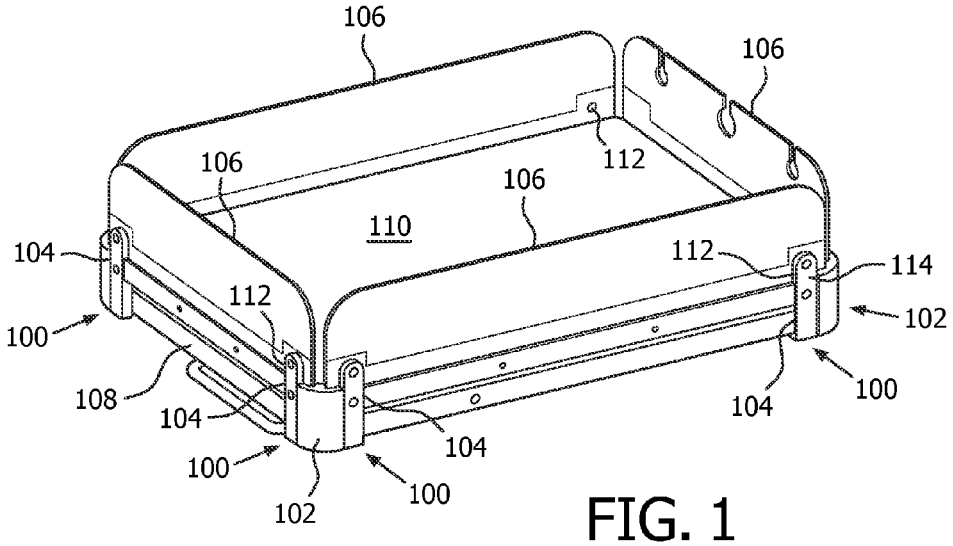
FIG. 1 is a diagram illustrating one example of a hinge for pivotally and removably connecting a member with a structure.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

FIG. 1 is a diagram illustrating one example of a hinge for pivotally and removably connecting a member 106 with a structure 108. As shown in the example, one or more members 106, such as, but not limited to, removable guards, barriers, protective walls and etc., are in a closed position coupled to a structure 108, e.g., a bed frame of an infant-care medical device such as a warmer having a bed 110. As illustrated, in the closed position, members 106 are securely coupled to structure 108 such that members 106 may not be removed without a user's directed action to decouple members 106 from structure 108. As also shown in this example, one or more spring-less hinges 100 may be configured to secure members 106 in the closed position. In this example, as shown, spring-less hinge 100 may comprise a first hinge piece 102 and a second hinge piece 104. As shown in this example, second hinge piece 104 may be configured to have a first facing surface 112 facing bed 110, and have a second facing surface 114 that is opposite of first facing surface 112. One of ordinary skill in the art will recognize that spring-less hinge 100 may include other suitable structure for pivotally and removably connecting members 106 with structure 108.

Figure 2:
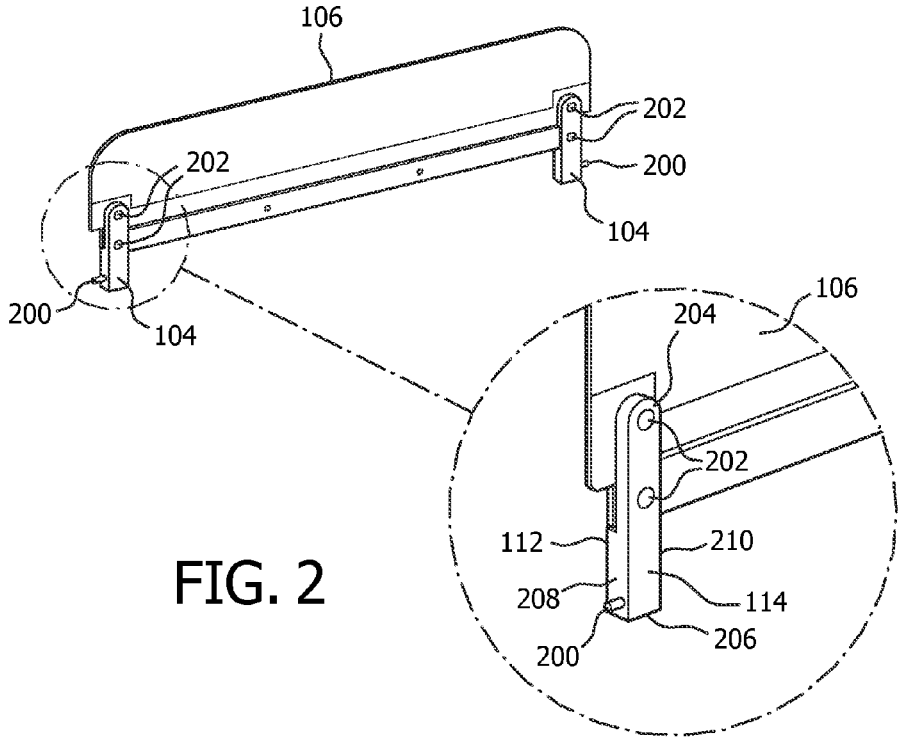
FIG. 2 is a diagram illustrating one example of a second hinge piece included in the hinge as shown in FIG. 1.

FIG. 2 is a diagram illustrating one example of second hinge pieces 104 as shown in FIG. 1. It will be described with reference to FIG. 1. As shown in this example, second hinge piece 104 may be coupled to member 106 using one or more screws 202 at a proximal end 204 of second hinge piece 104. Second hinge piece 104 may also comprise a protrusion 200 that is mounted to a distal end 206 of second hinge piece 104 and extends outwards from a first side (208) of second hinge piece 104 between planes corresponding to first facing surface 112 and second facing surface 114 as described in FIG. 1. It is understood although in this example protrusion 200 extends outwards from first side 208 of second hinge piece 104 as shown, protrusion 200 may also extend inwards from a second side 210 of hinge piece 104, opposite to first side 208 shown in this example. One of ordinary skill in the art will recognize second hinge piece 104 may be configured in any other suitable way to pivot between a closed and open position in accordance with the disclosure.

Figure 3:
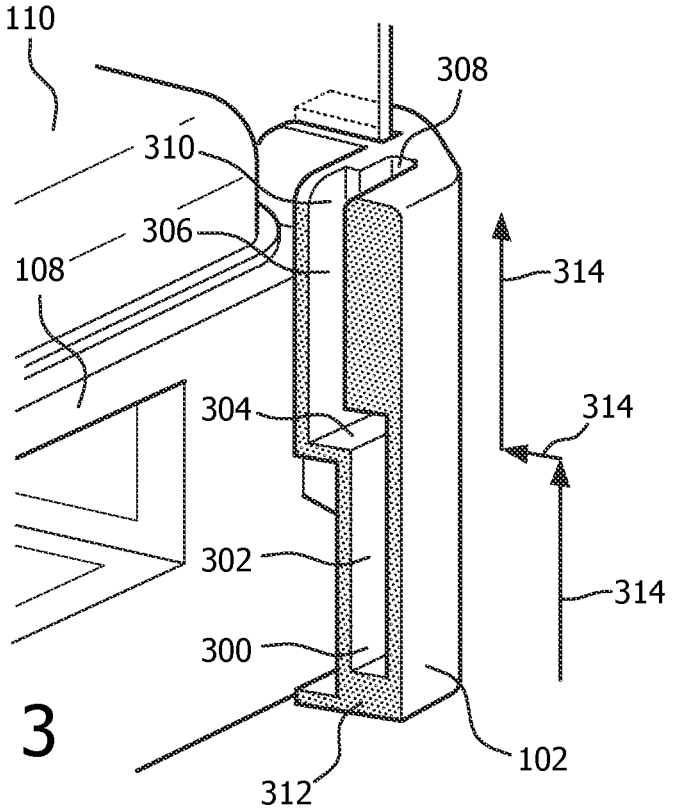
FIG. 3 is a diagram illustrating one example of a first hinge piece of the hinge as shown in FIG. 1.

FIG. 3 is a diagram illustrating one example of first hinge piece 102 as shown in FIG. 1. It will be described with reference to FIG. 1. As shown in this example, first hinge piece 102 may be mounted to structure 108 (e.g., bed frame 108 that supports bed 110 as shown in FIG. 1) and may comprise a slot 300 to facilitate retaining and pivoting of second hinge piece 104. Slot 300 may comprise a first slot portion 302, a diversion 304, a second portion 306, and a housing 308 as shown. As also shown in this example, first slot portion 302 may be closed at a first end 312 first hinge piece 102 such that it may retain second hinge piece 104 securely inside first hinge piece 102. As also shown in this example, second slot portion 306 may be opened at a second end 310 of first hinge piece 102 such that it allows second hinge piece 104 to be decoupled from first hinge piece 102. As shown in this example, housing 308 may be configured to be open at the second end 310 of first hinge piece 102 such that it may hold member 106 while in the closed position and as well as allow member 106 to be removed from structure 108. First slot portion 302 and second slot portion 306 are illustrated as being parallel in this example, but this not intended to be limiting. As still shown in this example, slot diversion 304 is disposed between first and second slot portions, i.e. 302 and 306. In this example, slot diversion 304 is configured to connect first slot portion 302 and second slot portion 306. The orientation of slot diversion 304 is transverse to each of first slot portion 302 and second slot portion 306. As illustrated, by virtue of the relative orientations of. slot portions 302, 306 and slot diversion 304, slot diversion 304 creates a recess between first slot portion 302 and second slot portion 306. As in this example, slot 300 may thus be configured to form a zigzag shape to facilitate retaining and pivoting of second hinge piece 104. One of ordinary skill in the art will recognize the illustrated configuration for first hinge piece 102 is just one exemplary configuration in accordance with the disclosure, and it is so illustrated by way of example, not as limitations. One of ordinary skill in the art will appreciate other suitable structure and as well as configurations for first hinge piece 102 in accordance with the disclosure.

Figure 4:
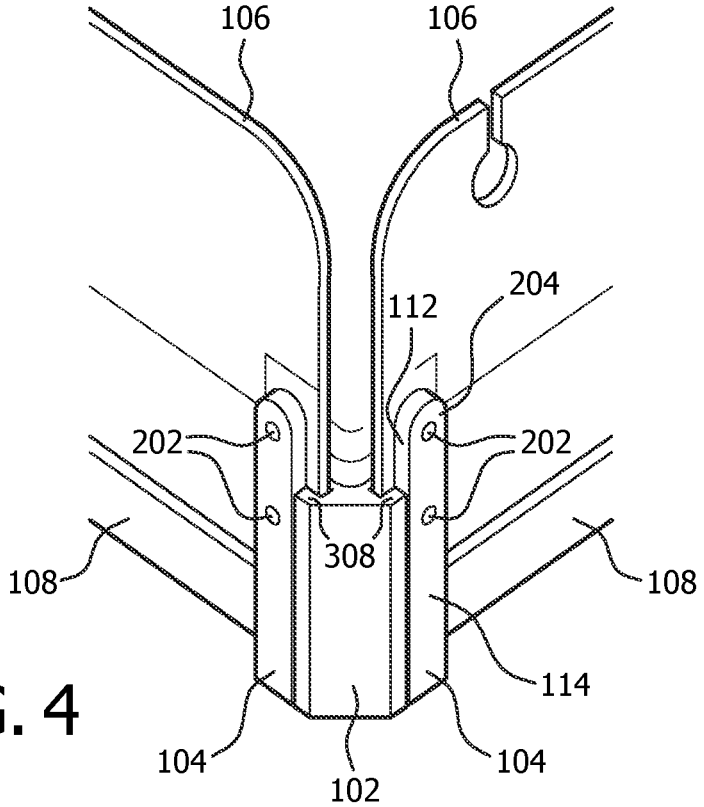
FIG. 4 is a diagram illustrating one example of using a hinge for pivotally and removably connecting a member with a structure.

FIG. 4 is a diagram illustrating one example of using spring-less hinge 100 to pivotally and removably connect members 106 with structure 108 in a closed position. It will be described with references to FIGS. 1-3. In this example, member 106 is coupled to structure 108 in the closed position. As shown, member 106 may be mounted to second hinge piece 104 using one or more screws 202 at a proximal end 204 of second hinge piece 104 as described in FIG. 1. In the closed position, as illustrated, member 106 may be securely held inside housing 308 provided by first hinge piece 102.

In this example, as shown, first hinge piece 102 may be mounted at a corner of structure of 108 to form an integral part of structure 108. As also shown in this example, first hinge piece 102 may comprise two housings 308 and slots 300 disposed on each side of first hinge piece 102. As so configured, first hinge piece 102 thus form a corner block for structure 108. Referring to FIG. 1, where four of such corner blocks may be used to pivotally and removably connecting four members 106. Particularly, at each side of structure 108, one side of two corner blocks, facing each other, may achieve the pivotally and removably connecting member 106 in accordance with the disclosure.

Figure 5:
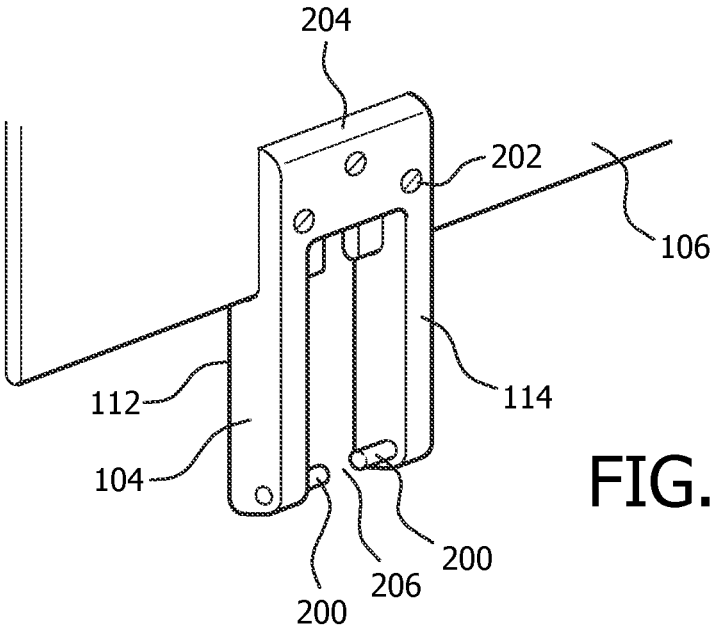
FIG. 5 is a diagram illustrating another example of second hinge piece of a hinge for pivotally and removably connecting a member with a structure.

FIG. 5 is a diagram illustrating another example of second hinge piece 104 of a spring-less hinge 100 for pivotally and removably connecting a member 106 with a structure 108 in accordance with the disclosure. It will be described with references to FIGS. 1-2. As shown in this example, second hinge piece 104 may be mounted to member 106 using screws 202 at a proximal end 204 of second hinge piece 104. As also shown, second hinge piece 104 may comprise protrusions 200 that extends inward facing each other from a side of second hinge piece 104 between planes corresponding to first facing surface 112 and second facing surface of second hinge piece 104.

Figure 6:
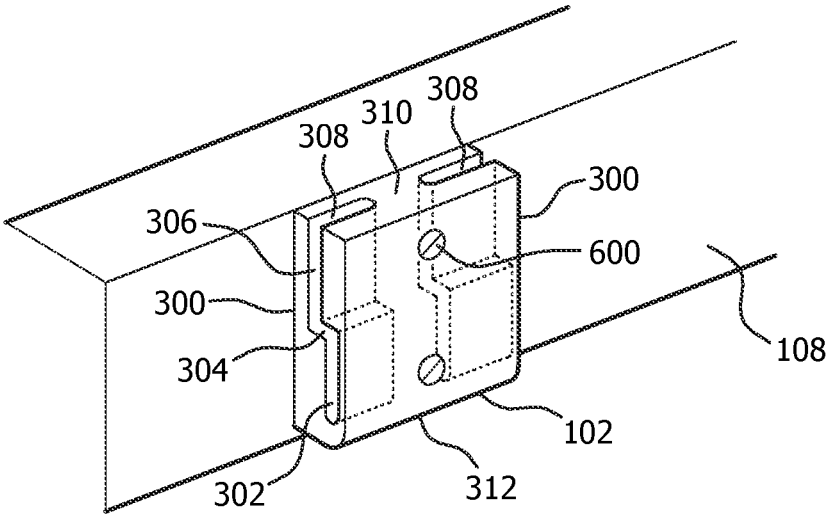
FIG. 6 is a diagram illustrating another example of first hinge piece of a hinge for pivotally and removably connecting a member with a structure.

FIG. 6 is a diagram illustrating another example of first hinge piece 102 of a spring-less hinge 100 for pivotally and removably connecting a member 106 with a structure 108 in accordance with the disclosure. It will be described with reference to FIGS. 1, 3 and 5. As shown in this example, first hinge piece 102 may be mounted to structure 108 (e.g., bed frame 108 that supports bed 110 as shown in FIG. 1) using screws 600 and may comprise slots 300 on each side of first hinge piece 102 to facilitate pivoting of second hinge piece 104. Slot 300 may comprise a first slot portion 302, a diversion 304, a second portion 306, and a housing 308 as shown. As shown in this example, first slot portion 302 may be closed at a first end of first hinge piece 102 such that it may hold second hinge piece 104 securely inside first hinge piece 102. As also shown in this example, second slot portion 306 may be opened at a first end 310 of first hinge piece 102 such that it allows first hinge piece 104 to be removed from second hinge piece 102. As shown in this example, housing 308 may be configured to be closed at a second end 312 of first hinge piece 102 such that it may hold member 106 while in the closed position. As still shown in this example, slot diversion 304 may be disposed between first and second slot portions, i.e. 302 and 306. In this example, slot diversion may also be configured to connect first slot portion 302 and second slot portion 306. As illustrated, in so connecting, slot diversion 304 may create a recess between first slot portion 302 and second slot portion 306. As in this example, slot 300 may be thus configured to form a zigzag shape to facilitate securing and pivoting of second hinge piece 104. As shown in this example, first hinge piece 102 may be configured to comprise two slots 300 on each side of first hinge piece 102 such that protrusions 200 of second hinge piece 104, as shown in FIG. 5, may be retained and pivoted inside first hinge piece 102.

Figure 7:
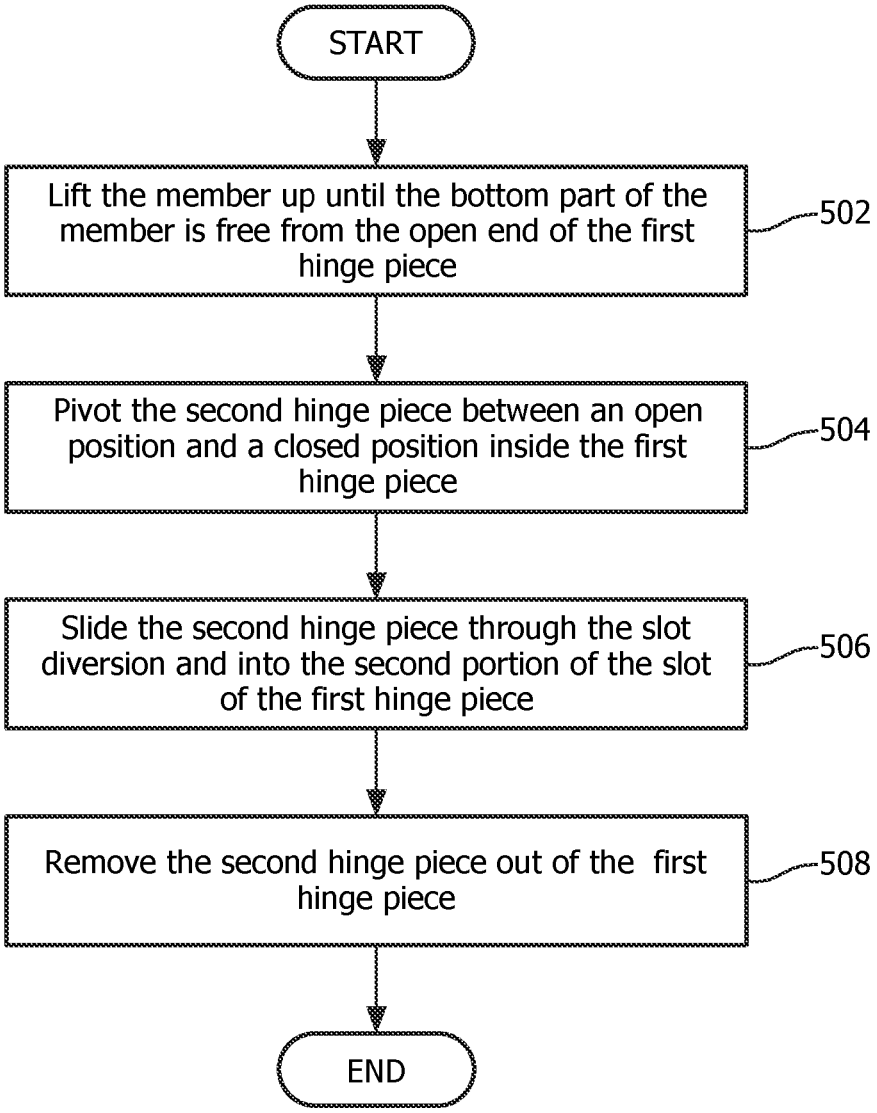
FIG. 7 is a flow chart illustrating one example of pivotally removing a member from a structure.

FIG. 7 is a flow chart illustrating one example of pivotally removing a member from a structure using one or more spring-less hinges 100 in accordance with the disclosure. It will be described with references to FIGS. 1-3. In operation, at block 502, a user may lift member 106 up until the bottom part of member 106 is free from the open end of first hinge piece 102. In some embodiments in accordance with the disclosure, first hinge piece 102 may comprise housing, e.g., housing 308 as shown in FIG. 3, such that housing 308 may secure member 106 in a closed position. At the closed position, housing 308 may be configured such that member 106 may not be decoupled from structure 108 without user's directed action to do so. For example, housing 308 may be configured to have a dimension that fits a portion of member 106 securely, as illustrated in FIG. 1. As also shown in the example illustrated by FIGS. 1 and 3, first hinge piece 102 may also be configured to have an open second end such that housing 308 is open at that end. As so configured, housing 308 allows member 106 to be lifted up from the closed position until the bottom part of member 106 is free from the open end of first hinge piece 102.

At block 504, in operation, the user may pivot second hinge piece 104 between the open position and closed position inside first hinge 102. For instance, in the example as illustrated by FIG. 3, protrusions 200 of second hinge piece 102 may facilitate such pivoting as the user directs a rotational force to flip member 106 downwards. In some embodiments in accordance with the disclosure, first hinge piece 102 and second hinge piece 104 may be configured such that second hinge piece 104 may only be free to pivot from the closed position to open position in response to protrusion 200 being located in slot diversion 304. The rotational force applied by the user to direct second hinge piece 104 to flip in a rotational direction away from first facing surface 112 and into second facing surface 114 as shown in FIGS. 1 and 3 may facilitate decoupling of second hinge piece 104 from first hinge piece 102.

At block 506, in operation, the user may slide second hinge piece through slot diversion 304 of first hinge piece 102 and into second slot portion 306. In some embodiments in accordance with the disclosure, as second hinge piece 104 is flipped through an operation described in block 504, second hinge piece is free to be slid through slot diversion 304 and into second slot portion 306 of slot 300. As so slidable, second hinge piece is considered to be in the open position. At block 506, in operation, the user may remove second hinge piece 104 out of first hinge piece 102 once second hinge piece 104 is in the open position.

It is understood the sequencing of the flow chart shown in FIG. 5 is only one example of pivotally removing a member from a structure using one or more spring-less hinges 100 in accordance with the disclosure. In some other examples, different sequencing of operations described in the flow chart may be arranged to achieve the pivotally removing a member from a structure in accordance with the disclosure. For example, blocks 502 and 504 may take place in operation at the same time. It is also understood in some other examples block 502 may not be needed to achieve pivotally removing a member from a structure using one or more hinges 100 in accordance with the disclosure.

Figure 8:
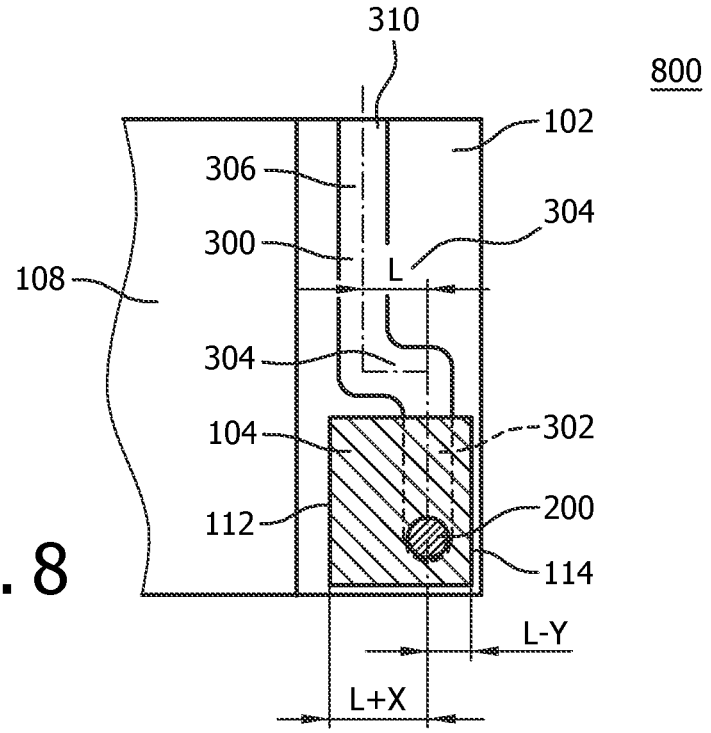
FIGS. 8-15 illustrate various examples to pivotally remove a member from a structure using a hinge.

FIGS. 8-12 illustrate examples to pivotally remove a member, e.g. member 106, from a structure, e.g., structure 108, using spring-less hinge 100. FIG. 8 illustrates one example of using spring-less hinge 100 to secure member 106 to structure 108 in a closed position as shown in FIG. 1. It will be described with references to FIGS. 1-3. In this example, as shown, spring-less hinge 100 may be configured to comprise first hinge piece 102 and second hinge piece 104. As shown, first hinge piece 102 may be mounted to structure 108 to form an integral part of structure 108. As also shown in this example, first hinge piece 102 may comprise a first slot portion 302, diversion 304, and second portion 306. First slot portion 302 may be closed at a first end of hinge piece 102 as shown and second slot portion 306 may be opened at a first end 310 of first hinge piece 102, as shown. As also shown diversion 304 connects first portion 302 with second slot portion 306. In this example, as shown, diversion 304 may create a recess for slot 300 and form a zigzag shape.

As also shown in this example, second hinge piece 104, having a first facing surface 112 and second facing surface 114. As shown, first facing surface 112 faces structure 108, may comprise a protrusion 200, e.g., but not limited to, an offset pin. As also shown, protrusion 200 may be configured to extend from a side of second hinge piece 104 between planes corresponding to first facing surface 112 and second facing surface 114. As shown in this example, second hinge piece 104 may be retained in first slot portion 302 of slot 300 such that member 106, mounted to second hinge piece 104, is secured to structure 108 in the closed position. In this example, as shown, this may be achieved by disposing the center of protrusion 200 on a distal end 206 of second hinge piece 104 such that a distance from first facing surface 112 to the center of protrusion 200 is greater than the slot diversion 304's length and a distance from second facing surface 114 to the center of protrusion 200 is not greater than the slot diversion 304's length.

The relationship among the distance from first facing surface 112 to the center of the protrusion, slot diversion 304's length, and the distance from second facing surface 114 to the center of protrusion 200 may be represented by the following formulas:

Slot diversion 304's length=$L$ mm;

First facing surface 112 to the center of the protrusion 200=$L+X$ mm;

and

The distance from second facing surface 114 to the center of the protrusion 200=L−Y mm; wherein, L and X are greater than 0 and Y is greater than or equal to 0.

Figure 9:
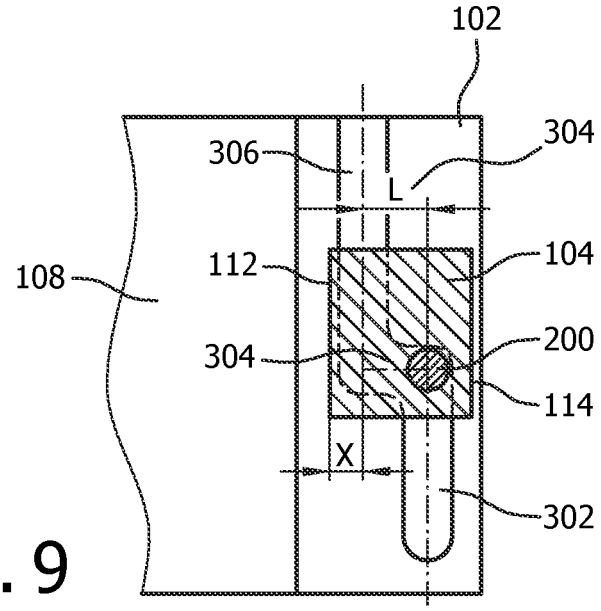

FIG. 9 illustrates another example of using spring-less hinge 100 as shown in FIG. 8 for securing member 106 to structure 108 in a closed position. It will be described with references to FIGS. 1-3 and FIG. 8. As shown, in the example, in the closed position as described in FIG. 8, second hinge piece 104 may be slid through first slot portion 302 to slot diversion 304. However, second hinge piece 104 may not be slid any further in the closed position as shown in this example because slot diversion 304's length (L) is smaller than the distance between first facing surface 112 of second hinge piece 104 and the center of protrusion 200. As shown, protrusion 200 may be disposed such that the distance between first facing surface 112 of second hinge piece 104 and the center of protrusion 200 is greater than the length of slot diversion 304 by a positive value X mm (millimeter). As a result, the engagement of first facing surface 112 with first hinge piece 102 prevents protrusion 200 from passing through slot diversion 304 and into second slot portion diversion 306, and therefore retains protrusion 200 in the first slot portion 302 or in slot diversion 304 at the closed position.

Figure 10:
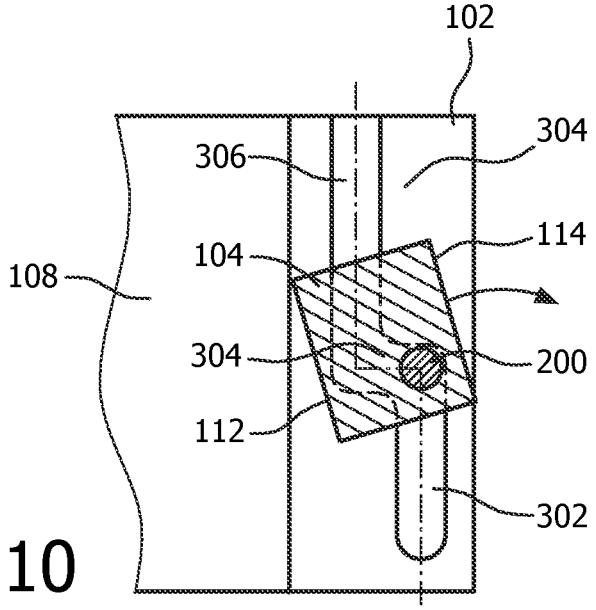

FIG. 10 illustrates one example of using spring-less hinge 100 for pivotally removing member 106 from structure 108 in an open position. As shown in this example, protrusion 200 of second hinge piece 104 may be slid to slot diversion 304. As described in FIG. 9, in the closed position, the engagement of first facing surface 112 with first hinge piece 102 prevents protrusion 200 from passing through slot diversion 304 and into second slot portion diversion 306. This example shows, as illustrated, second hinge piece 104 may however be pivoted to an open position at slot diversion 304. As shown, to so pivot, protrusion 200, e.g., an offset pin may be used to pivot at slot diversion 304 in a rotational direction towards second facing surface 112 of second hinge piece 104. As a result, first facing surface 112 of second hinge piece 104 may be rotated away from structure 108.

Figure 11:
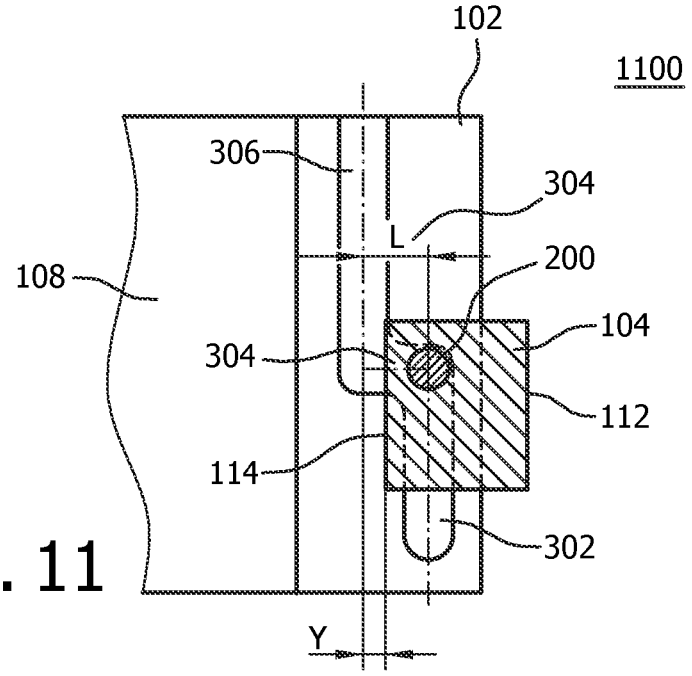

FIG. 11 illustrates another example of using spring-less hinge 100 for pivotally removing member 106 from structure 108 in an open position. As described in FIG. 10, second hinge piece 104 may be pivoted from a closed position to an open position. In the open position as shown in this example, first facing surface 112 of second hinge piece 104 may be rotated to a plane away from structure 108 and second facing surface 114 of second hinge piece 104 may be rotated to face structure 108. As a result, the second hinge piece is inverted at the open position such that the first facing surface 112 faces away structure 108 while second facing surface 114 faces towards structure 108. As also shown in this example, protrusion 200 of second hinge piece 104 may be slid through slot diversion 304 and into second portion 306 to facilitate decoupling of second hinge piece 104 from first hinge piece 102. As shown, second hinge piece 104 is so slidable because second hinge piece 104 is configured such that the slot diversion 304's length (L) is greater than the distance between second facing surface 114 of second hinge piece 104 the center of protrusion 200 by a non-negative value of Y mm. As shown, in the open position, i.e., second hinge piece 104 may be pivoted inside first hinge piece 102 such that second facing surface 114 of second hinge piece 104 faces toward structure 108, second hinge piece may be free to slide through slot diversion 304 and into second portion 306.

Figure 12:
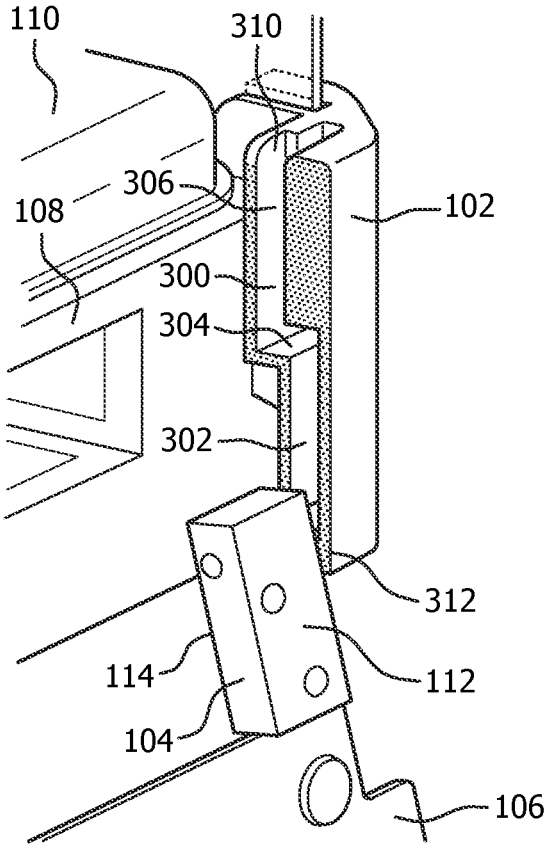

FIGS. 12-15 illustrate examples of pivotally removing member 106 from structure 106 using spring-less hinge 100 at an open position. They will be described with references to FIGS. 1-3. As shown in FIG. 12, second hinge piece 104 may be pivoted from a closed position to an open position as described in FIGS. 10-11. As shown in this example, second hinge piece 104 may be inverted to a position such that its first facing surface 112 facing away structure 108 and second facing surface 114 facing towards structure 108. In this example, as shown, member 106 may be flipped upside-down vertically at the open position. As also shown in this example, in the open position, second facing surface 114 of second hinge piece 104 faces structure 108 and first facing surface 112 faces away structure 108. As still shown in this example, first hinge piece 102 may be retained in first slot portion 302 of slot 300 first at second end 312 which is closed in this example, of first hinge piece 102.

Figure 13:
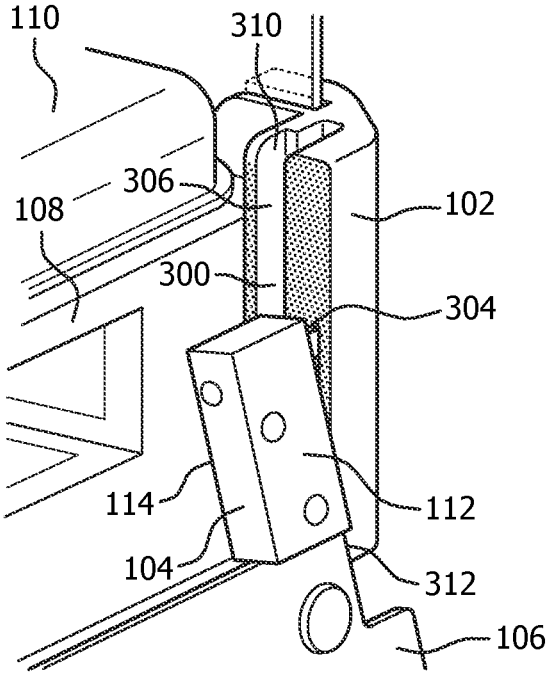
Figure 14:
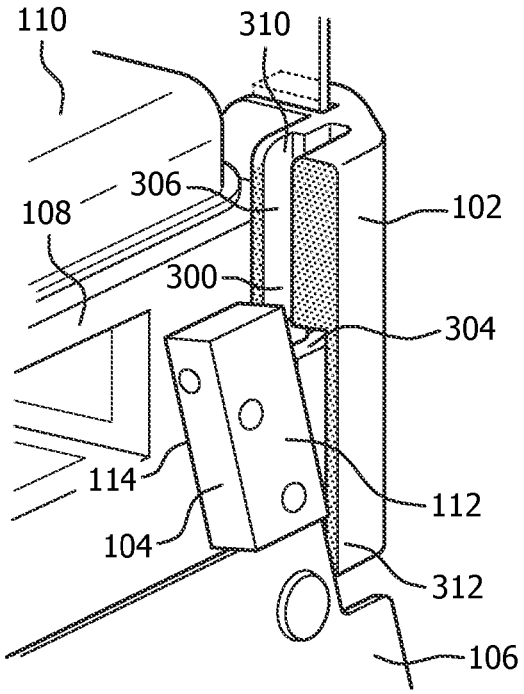
Figure 15:
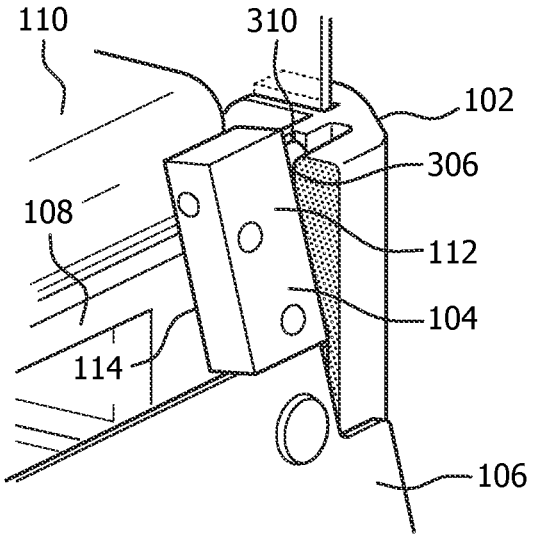

As shown in FIG. 13, second hinge piece 104, in the inverted position, may be slid through first slot portion 302 and into slot diversion 304 when second piece 104 has been pivoted to the open position. As shown in FIG. 14, when second hinge piece 104 is still at slot diversion 304, it may be pushed towards structure 108, e.g., by a Y mm as described in FIG. 11. As a result of so pushing, second hinge piece is free to be slid into second slot portion 306, as shown in FIG. 16. FIG. 16 illustrates that second hinge piece may be slid into second slot portion 306 and out of the first end 310 of first hinge piece 102, which is open as shown in this example, to facilitate decoupling of member 106 from structure 108.

As so configured in accordance with the disclosure, spring-less hinge 100 may provide a removable-member solution that overcomes issues associated with traditional removable mechanism, such as the spring loaded spring. For example, without a spring, spring-less hinge 100 avoids the reliability issue typically associated with a spring as the spring wears and tears. Through the slot means and the hinge means configuration, spring-less hinge 100 may also securely retain members in a closed position and only allows the members to be unlocked and removed from structure only by a rotational force consciously directed by a user. In so configuring, spring-less hinge 100 may prevent members from being accidentally removed from structure through other user actions. That is, if the user just applies a force without a directed action to open the members in accordance with the disclosure, the user may not remove the members. For instance, in a case where an infant fiddles with member guards of an infant care device like a warmer while the guards are coupled to the warmer, spring-less hinge 100 may prevent the guards from being decoupled as it is be possible to accomplish the directed action to open the member as disclosed from inside the warmer. With a slot in the first hinge piece 102 and removable second hinge piece, spring-less hinge 100 also allows easy and thorough cleaning which may be important to applications like infant care devices.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the description provided above provides detail for the purpose of illustration based on what is currently considered to be the most practical and preferred embodiments, it is to be understood that such detail is solely for that purpose and that the disclosure is not limited to the expressly disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

The invention claimed is:

1. A spring-less hinge for pivotally and removably connecting a member with a structure, the member comprising a sidewall, the member being movable from a closed position to an opened position relative to the structure and being removable from the structure, the hinge comprising:

a first hinge piece constructed and arranged to be coupled to the structure and a second hinge piece constructed and arranged to be coupled to the member, wherein the first hinge piece comprises a recessed portion, wherein responsive to the member being in the closed position, an end portion of the member sidewall is received in the recessed portion such that the member remains in the closed position until a force is exerted on the member in a particular direction, wherein the second hinge piece is moved from a first position to a second position relative to the first hinge piece when the member is moved from the closed position to the open position, wherein the first and second hinge pieces are configured such that when the second hinge piece is in the first position, the second hinge piece cannot be decoupled from the first hinge piece but can be pivoted to the second position relative to the first hinge piece, wherein when the second hinge piece is pivoted to the second position the member is generally extending downwardly and the end portion of the member sidewall is outside of the recessed portion, and wherein responsive to the second hinge piece being in the second position, it can then be slid upwardly relative to the first hinge piece to enable the second hinge piece to be decoupled from the first hinge piece.

2. The spring-less hinge of claim 1, wherein the first hinge piece further comprises a slot, wherein the second hinge piece comprises a protrusion, and wherein the slot is configured to:

allow the second hinge piece to pivot therein between the first position and the second position; and provide a path for the protrusion to enable the second hinge piece to be slid through the slot and decoupled from the slot when the second hinge piece is pivoted to the second position.

3. The spring-less hinge of claim 2, wherein the slot comprises:

a first slot portion that is closed at a first end of the slot;

a second slot portion opened at a second end of the slot opposite the first end; and a slot diversion that is configured to offset the first portion from second portion; and wherein the second hinge piece is configured such that, responsive to the protrusion being located in the first slot portion or in the slot diversion, the second hinge piece is free to pivot between the first position and the second position, wherein at the first position the slot diversion retains the protrusion in the first slot portion, and wherein at the second position the protrusion is slidable through the slot diversion and into the second slot portion to facilitate decoupling of the second hinge piece from the first hinge piece.

4. The spring-less hinge of claim 2, wherein the protrusion is configured to be prevented from being decoupled from the slot when the second hinge piece is in the first position.

5. The spring-less hinge of claim 4, wherein the spring-less hinge comprises a first facing surface and a second facing surface opposite the first facing surface, and wherein the protrusion is configured such that at the first position a distance from the first facing surface to the center of the protrusion is greater than a distance from the second facing surface to the center of the protrusion.

6. The spring-less hinge of claim 1, wherein the second hinge piece comprises a proximal end and a distal end, wherein a protrusion is coupled to the distal end, and wherein the second hinge piece is coupled to the member at the proximal end via one or more screws.

7. A spring-less hinge for pivotally and removably connecting a member with a structure, the member comprising a sidewall, the member being movable from a closed position to an opened position relative to the structure and being removable from the structure, the hinge comprising:

first hinge piece means constructed and arranged to be coupled to the structure and a second hinge piece means constructed and arranged to be coupled to the member, wherein the first hinge piece means comprises a recessed portion, wherein responsive to the member being in the closed position, an end portion of the member sidewall is received in the recessed portion such that the member remains in the closed position until a force is exerted on the member in a particular direction, wherein the second hinge piece means is moved from a first position to a second position relative to the first hinge piece means when the member is moved from the closed position to the open position, wherein the first and second hinge piece means is configured such that when the second hinge piece means is in the first position, the second hinge piece means cannot be decoupled from the first hinge piece means but can be pivoted to the second position relative to the first hinge piece means, wherein when the second binge piece means is pivoted to the second position the member is generally extending downwardly and the end portion of the member sidewall is outside of the recessed portion, and wherein responsive to the second hinge piece means being in the second position, it can then be slid upwardly relative to the first hinge piece means to enable the second hinge piece means to be decoupled from the first hinge piece means.

8. The spring-less hinge of claim 7, wherein the first hinge piece means further comprises a slot means, wherein the second hinge piece means comprises a protrusion means, and wherein the slot means is configured to:

allow the second hinge piece means to pivot therein between the first position and the second position; and provide a path for the protrusion to enable the second hinge piece means to be slid through the slot means and decoupled from the slot means when the second hinge piece is pivoted to the second position.

9. The spring-less hinge of claim 8, wherein the slot means comprises:

a first slot portion means that is closed at a first end;

a second slot portion means opened at a second end of the slot opposite the first end; and a slot diversion means that is configured to offset the first slot portion means from second portion means; and wherein the second hinge piece means is configured such that, responsive to the protrusion being located in the first slot portion means or in the slot diversion means, the second hinge piece is free to pivot between the first position and the second position, wherein at the first position the slot diversion means retains the protrusion means in the first slot portion means, and wherein at the second position the protrusion means is slidable through the slot diversion means and into the second slot portion means to facilitate decoupling of the second hinge piece means from the first hinge piece means.

10. The spring-less hinge of claim 8, wherein the protrusion means is configured to be prevented from being decoupled from the slot when the second hinge piece means is in the first position.

11. The spring-less hinge of claim 10, wherein the spring-less hinge comprises a first facing surface and a second facing surface opposite the first facing surface, and wherein the protrusion means is configured such that at the first position a distance from the first facing surface to the center of the protrusion means is greater than a distance from the second facing surface to the center of the protrusion means.

12. The spring-less hinge of claim 7, wherein the second hinge piece means comprises a proximal end and a distal end, wherein a protrusion is coupled to the distal end, and wherein the second hinge piece is coupled to the member at the proximal end via one or more screws.

* * * * *